US006754986B2

(12) United States Patent
McLaughlin

(10) Patent No.: US 6,754,986 B2
(45) Date of Patent: Jun. 29, 2004

(54) ADVERTISEMENT DELIVERY SYSTEM FOR OVERHEAD GARAGE DOOR ENTRYWAY

(76) Inventor: Maxwell John McLaughlin, OS 510 Cornell Ave., Villa Park, IL (US) 60181

( * ) Notice: Subject to any disclaimer, the term of this patent is extended or adjusted under 35 U.S.C. 154(b) by 0 days.

(21) Appl. No.: 10/145,159

(22) Filed: May 14, 2002

(65) Prior Publication Data

US 2002/0124976 A1 Sep. 12, 2002

Related U.S. Application Data

(62) Division of application No. 09/752,852, filed on Jan. 2, 2001, now Pat. No. 6,386,262.

(51) Int. Cl.[7] ..... G09F 17/00
(52) U.S. Cl. ..... 40/603; 160/113
(58) Field of Search ..... 40/603, 160

(56) References Cited

U.S. PATENT DOCUMENTS

| | | | | | |
|---|---|---|---|---|---|
| 3,021,896 | A | * | 2/1962 | Buono et al. | 160/113 |
| 3,103,967 | A | * | 9/1963 | Gaschen | 160/113 |
| 3,126,944 | A | * | 3/1964 | Kempinski | 160/113 X |
| 3,938,577 | A | * | 2/1976 | Richards | 160/113 X |
| 4,673,019 | A | * | 6/1987 | Silverthorne et al. | 160/268 |
| 5,050,660 | A | * | 9/1991 | Bleichwehl et al. | 160/113 |
| 5,649,390 | A | * | 7/1997 | Davidson | 40/603 X |
| 5,848,630 | A | * | 12/1998 | Manzo | 160/113 |
| 6,059,005 | A | * | 5/2000 | Zinbarg | 40/603 X |
| 6,386,262 | B1 | * | 5/2002 | McLaughlin | 160/113 |

* cited by examiner

*Primary Examiner*—Joanne Silbermann

(57) ABSTRACT

A flexible retractable screen assembly is disclosed for any garage door of the type that ends with the garage door substantially parallel to a garage floor when in a fully opened condition. The assembly includes a frame sub-assembly with bases 21R, 21L symmetrically disposed in the corners of an entire interior side of a garage door. Vertically positioned flexible track members 41L, 41R disposed at opposite ends of garage door are mounted, elevated off door to traverse an entire height of garage door, in respective end corner bases 21R or 21L. Flexible dual-purpose conjunctive rods 60L, 60R, disposed at opposite ends, slidably engages respective bases 21R or 21L and tracks 41L, 41R and screen sub-assembly attachment slips 90L, 90R. Fixedly attached to each rod 60L, 60R above and below screen sub-assembly attachment slips 90L, 90R to restrict their movement are respectively, a horizontal support brace 82 and a concert drag 72. A rod end 63L of each respective rod 60L, 60R increases in dimension and acts as a wedge to releasably lock each rod 60L, 60R in its respective base 21R, 21L, during operation of a garage door. A single screen panel sub-assembly consists of attachment slips 90L, 90R, vertically positioned disposed at opposite ends on vertical seams 37L, 37R between a main portion 99 and each of an adjacent side auxiliary portions 92L, 92R, and an adjacent upper auxiliary portion 96. When in a deployed condition, hook and loop fasteners are used to enclose openings, not enclosed by main portion 99, at top between bottom panel of a garage door (not shown) and a header of a garage door jam (not shown) and at sides as rods 60L, 60R telescope bowing outwardly from tracks 41L, 41R and back to engage a garage floor (not shown).

10 Claims, 9 Drawing Sheets

ADVERTISEMENT DELIVERY SYSTEM FOR OVERHEAD GARAGE DOOR ENTRYWAY

This is a division of Ser. No. 09/752,852 filed Jan. 2, 2001 now U.S. Pat. No. 6,386,262.

BACKGROUND

1. Field of Invention

This invention relates to advertising expressions within a garage door entryway, specifically to an improved mounting configuration for a single screen panel retractably mounted substantially across the entire interior surface of any garage door that ends in a fully opened condition substantially parallel to a floor of a garage.

2. Discussion of Prior Art

Many residential garages do not have windows or the windows do not provide an opening sufficient to properly ventilate a large garage. Generally, the air inside the garage tends to stagnate and get quite hot, particularly during summer months and in southern climates. Additionally, the interior of the garage tends to collect obnoxious odors from elements exposed to or stored within the garage such as, automobile exhaust, skinned squirrel or cat carnage, or trash or garbage. Historically, the best way to ventilate a large garage was to leave the overhead door open. However, if no barrier is in place, festive activities can become very unpleasant when insects attracted by the food or the body heat of the participants join the party.

Thereafter, inventors created several types of screen enclosures for garage door openings. Historically, screen enclosures could be grouped into the following categories: free-standing, roll-up, or interior mounted. The free-standing enclosures were completely separate from the garage and had to be positioned in a garage door opening usually requiring attachment to the exterior of the garage door jam. Therefore, free-standing enclosures may have required multiple persons to deploy or an additional space to store. Storage concerns were addressed by both roll-up and interior mounted type enclosures. The roll-up types were mounted to the structural elements of a garage, which required knowledge of such.

Two types of screen devices affixed to an interior surface of a garage door have been proposed—for example, U.S. Pat. No. 5,611,382 to Sferra (1997) and U.S. Pat. No. 4,653,566 to Miale (1987). Although convenient to store, deployable at a plurality of heights, and retractable by complimentary rigid slide members firstly attached to a garage door, such screen assemblies are limited by the following:

(a) Conventional track members cannot traverse the entire height of a garage door due to their lack of flexibility to negotiate bends associated with the operation of a sectional garage door;
(b) The height of potentially crossing inherent garage door connecting or supporting means obstructs a line of sight of a track when firstly attached to a garage door;
(c) The length of run of a track restricts the height of a screen panel that can be utilized;
(d) Unless part of a garage door is relatively perpendicular to a floor when open, parallel rigid panels successively slidably mounted to one another cannot properly depend from a garage door to a floor;
(e) With telescoping screen panels, the lower screen panel is incrementally further from a garage door than a preceding screen panel creating an increasing gap at the ends as more panels are utilized;

(f) Any bolts perforating a garage door to secure a screen device to the interior side of the garage door decreases the efficiency of the door to insulate and act as a thermal barrier.

SUMMARY

In accordance with the present invention described and claimed herein comprises a frame sub-assembly with bases symmetrically disposed in the corners of an entire interior side of a garage door; flexible track members disposed at opposite ends vertically positioned traversing entire height of garage door mounted in respective end corner bases; flexible dual-purpose conjunctive rods disposed at opposite ends slidably engage respective tracks and screen sub-assembly attachment slips; fixedly attached to each rod above and below screen sub-assembly attachment slips to restrict their movement are respectively, a horizontal support brace and a concert drag, and a screen sub-assembly with attachment slips vertically positioned disposed at opposite ends of a main portion, and two adjacent side auxiliary portions and an adjacent upper auxiliary portion that enclose openings via hook and loop fasteners at sides as rods telescope from tracks to engage a garage floor and between garage door and header at top when garage door is in a raised condition.

OBJECTS AND ADVANTAGES

Accordingly, besides the objects and advantages of the screen assemblies described in my above patent, several objects and advantages of the present invention are:

(a) to provide unconventional fabricated components of predetermined dimension to allow imperforate mounting of track elevated parallel to the interior side of a garage door and to allow screen assembly to traverse entire height of a garage door;
(b) to provide a garage door screen assembly that employs a single screen panel that stores neatly, compactly and permanently against the interior of the garage door so that garage clutter is reduced;
(c) to provide wedge principal means to releasably lock telescoping fabricated components of predetermined dimension;
(d) to provide a screen assembly for a garage door that is permanently and retractably mounted to the interior of the garage door but which does not interfere with or affect the operation of the door when use of the screen assembly is not required;
(e) to provide a screen assembly for a garage door that is conveniently designed to allow easy manual operation;
(f) to provide a screen assembly for a garage door that significantly improves air circulation and lighting, while still maintaining privacy within the garage.

This invention results from a realization that an improved garage door screen assembly can be accomplished by the imperforate mounting of a retractable frame sub-assembly to an interior side of a garage door. The frame sub-assembly is further attached to a single screen panel sub-assembly. The screen sub-assembly consists of attachment slips mounted to a main portion with auxiliary portions attached vertically at its side ends and horizontally at its top. Furthermore, using lightweight material of superior strength to fabricate unique parts of predetermined dimension allows manual means, wedge principal means, and adhesive means to be the most effective means to, respectively, deploy, releasably lock, and attach a screen assembly. The invention features a retractable screen assembly for any garage door that ends in a fully opened condition substantially parallel to a floor of a garage.

Further objects and advantages are to provide a garage door screen assembly which can be quickly and reliably deployed when needed to prevent leaves, insects, and pests from entering the garage, economically manufactured, and utilized as a personal billboard. To date no other garage screen assembly stores by permanent imperforate mounting to an interior surface of a garage door and encloses all breaches created by a door in a fully raised condition with a single screen panel. Still further objects and advantages will become apparent from a consideration of the ensuing description and drawings.

DRAWING FIGURES

In the drawings, closely related figures have the same number but different alphabetic suffixes.

DESCRIPTION—ALTERNATE EMBODIMENT

Figure 1:
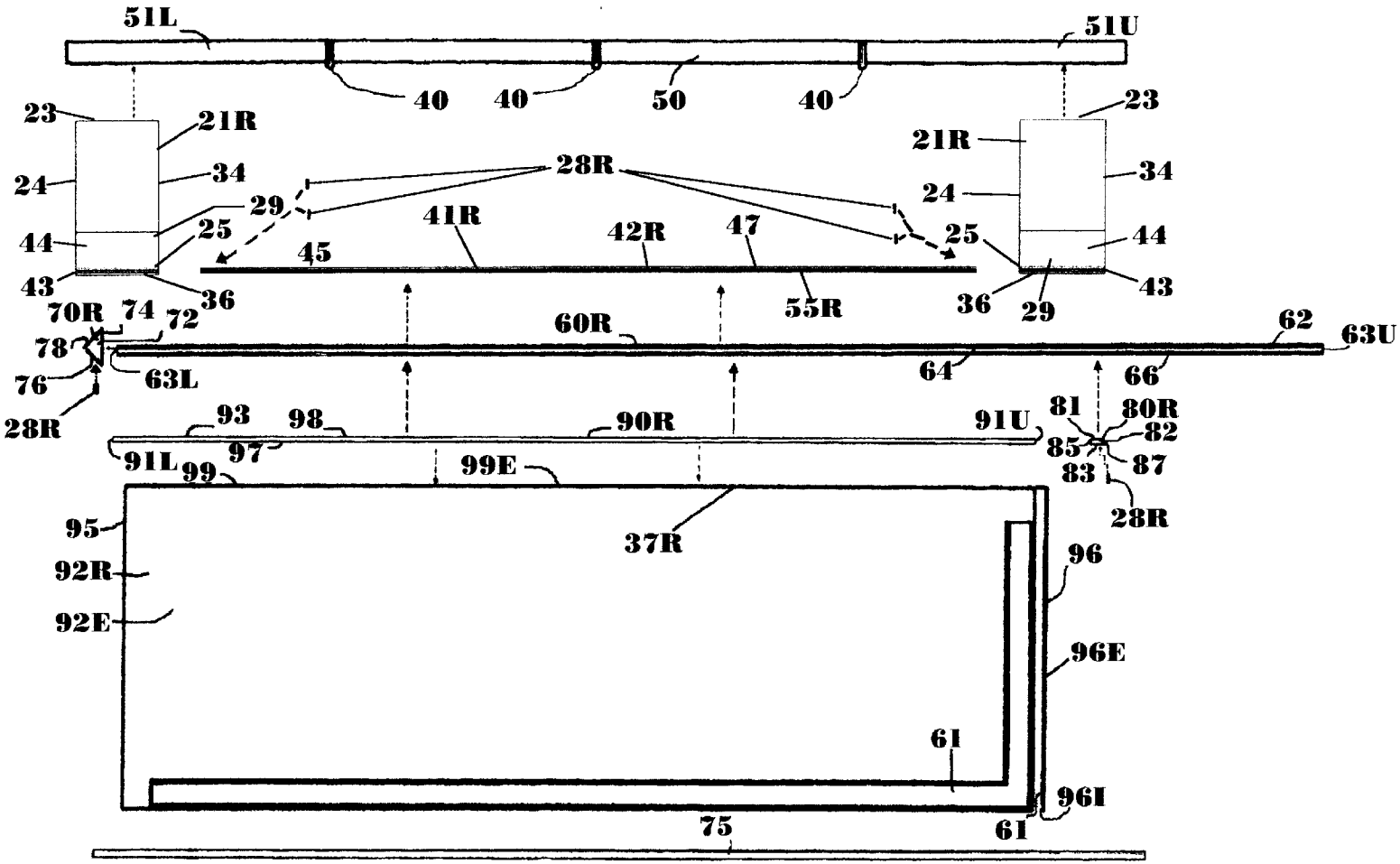
FIG. 1 is an exploded side view of parts of the total improved garage screen assembly of the present invention in a relaxed condition relatively positioned to a sectional garage door.

Referring to FIG. 1, shown are the parts when concerted comprise the screen assembly of the present invention in relational position to a sectional garage door 50 substantially parallel to a garage floor 75. A plurality of fabricated bases 21R are shown positioned below their incorporation points on a lower panel 51L and on an upper panel 51U of said garage door 50. Supplementary identical bases 21L incorporated horizontally at an opposite end of said garage door 50 is not shown in FIG. 1. (See FIG. 2) Said bases 21R, 21L incorporate a contacting plate 23, a tower 44, and an end of a vertical track 43 with a cradle 25. Said cradle 25 has shown a front 24, rear 34, base 36, and right 29 sides. Shown is a fabricated track 41R that has a pair of footings 42R, 42L at each side of an elongated flexible housing 47, an upper constraint arm 45, and lower constraint arms 55R, 55L. Said footing 42L and lower constraint arm 55L are not shown in FIG. 1. (See FIG. 2) Supplementary identical track 41L incorporated parallel to the above track 41R at an opposite end of said garage door 50 is not shown in FIG. 1. (See FIG. 2) A fabricated flexible dual-purpose conjunctive frame rod 60R is shown positioned below its incorporation point in said track 41R. Said rod 60R has a predetermined length greater than that of said track 41R, an upper segment 62, a middle segment 64, a lower segment 66, and two ends 63L, 63U. A supplementary identical rod 60L incorporated parallel to the above rod 60R at an opposite end of said garage door 50 is not shown in FIG. 1. (See FIG. 2) An end 70R of a fabricated horizontal drag 72 is shown at its relative incorporation point on the end 63L of said rod 60R. Said drag 72 has shown a base 74, right leg 76, and left leg 78 sides. An end 80R of a fabricated horizontal brace 82 is shown at its relative incorporation point on the lower segment 66 of said rod 60R. Said brace 82 has shown a top 81, bottom 83, front 85, and rear 87 sides. A fabricated flexible vertical screen attachment slip 90R is shown between its relative incorporation points, respectively, on the lower segment 66 of said rod 60R between said drag 72 and said brace 82, and on a vertical seam 37R of a single screen panel 95. A supplementary identical screen attachment slip 90L incorporated parallel to the above slip 90R at an opposite end of screen panel 95 is not shown in FIG. 1. (See FIG. 3) Said slip 90R has shown two ends 91L, 91U, a top 93, bottom 97, and right 98 sides. A single screen panel 95 is shown draping at its relative incorporation point on said bottom side 97 of said slip 90R. Said screen panel 95 consists of a main portion 99, two side portions 92R, 92L, the opposite side portion 92L not shown in FIG. 1 (See FIG. 3), and an upper portion 96. Said upper portion 96 has both an exterior side 96E and an interior side 961. One half of a hook and loop fastener 61 is attached to an exterior side 92E of said side portions 92R, 92L and to said interior side 961 of said upper portion 96. Pins 28R are shown at incorporation junctions between said bases 21R and said track 41R, said rod 60R and said drag 72, and said rod 60R and said brace 82. A supplementary identical pin 28L for junctions at other end of said garage door 50 is not shown in FIG. 1. (See FIG. 2) All above parts are more thoroughly described below.

Figure 2:
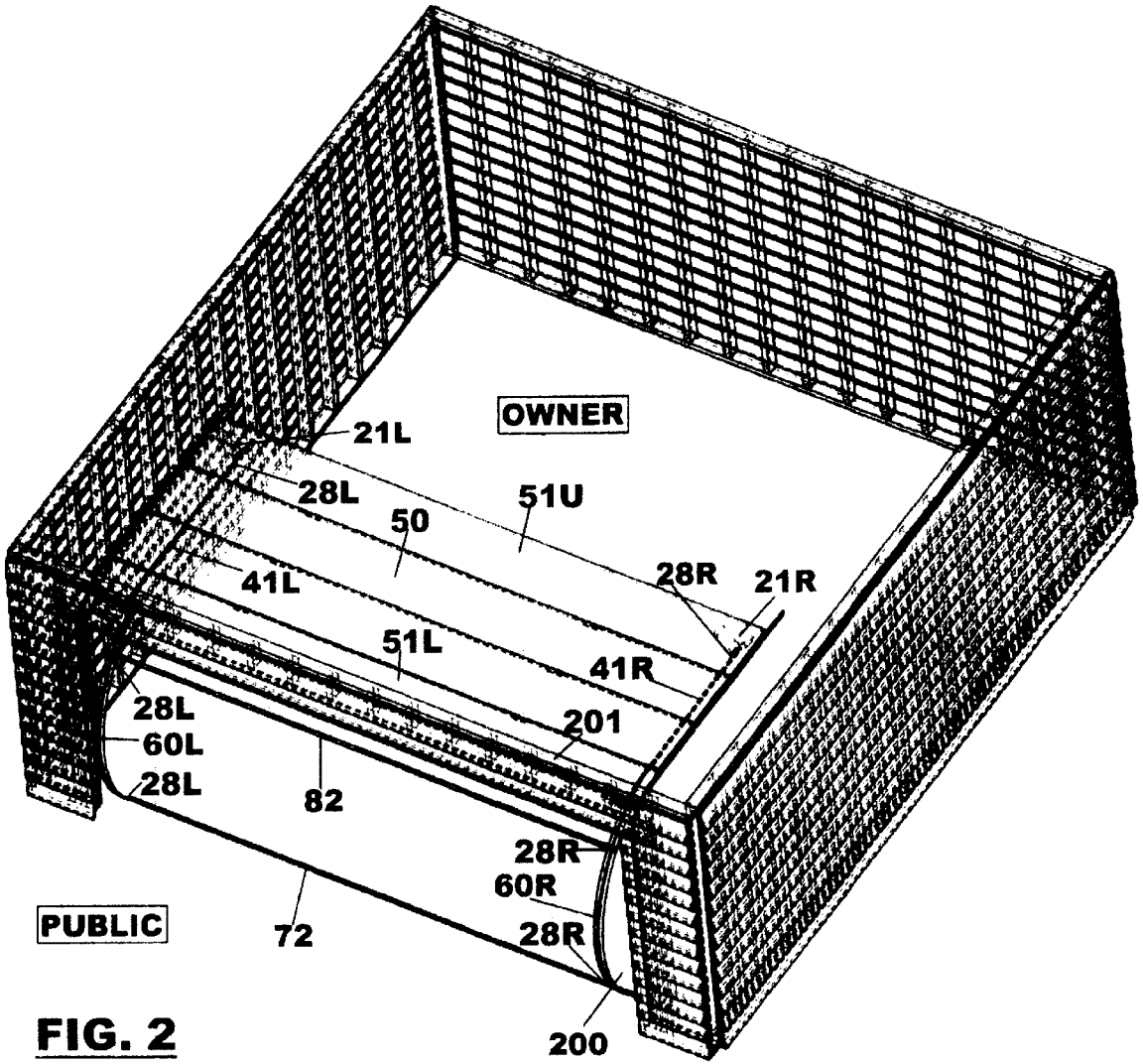
FIG. 2 is a distant left elevation perspective view of parts of the frame sub-assembly of the present invention in an extended and flexed condition disposed within an overhead garage door entryway.

Referring to FIG. 2, shown are the parts that comprise the frame sub-assembly of the present invention. Said bases 21R, 21L are shown disposed in the corners of a sectional garage door, said bases on said lower panel 51L are not visible from this perspective, due to a header structure 201 of an overhead garage door entryway 200. Disposed between either pair of said bases 21R or 21L is respective said track 41R or 41L vertically positioned in a flexed condition. Disposed in-line with each said track 41R, 41L is respective said rod 60R or 60L vertically positioned in a flexed condition. Disposed horizontally between said rods 60R, 60L are the horizontal drag 72 and the horizontal brace 82. Said pins 28R, 28L are shown at their incorporation points.

Figure 3:
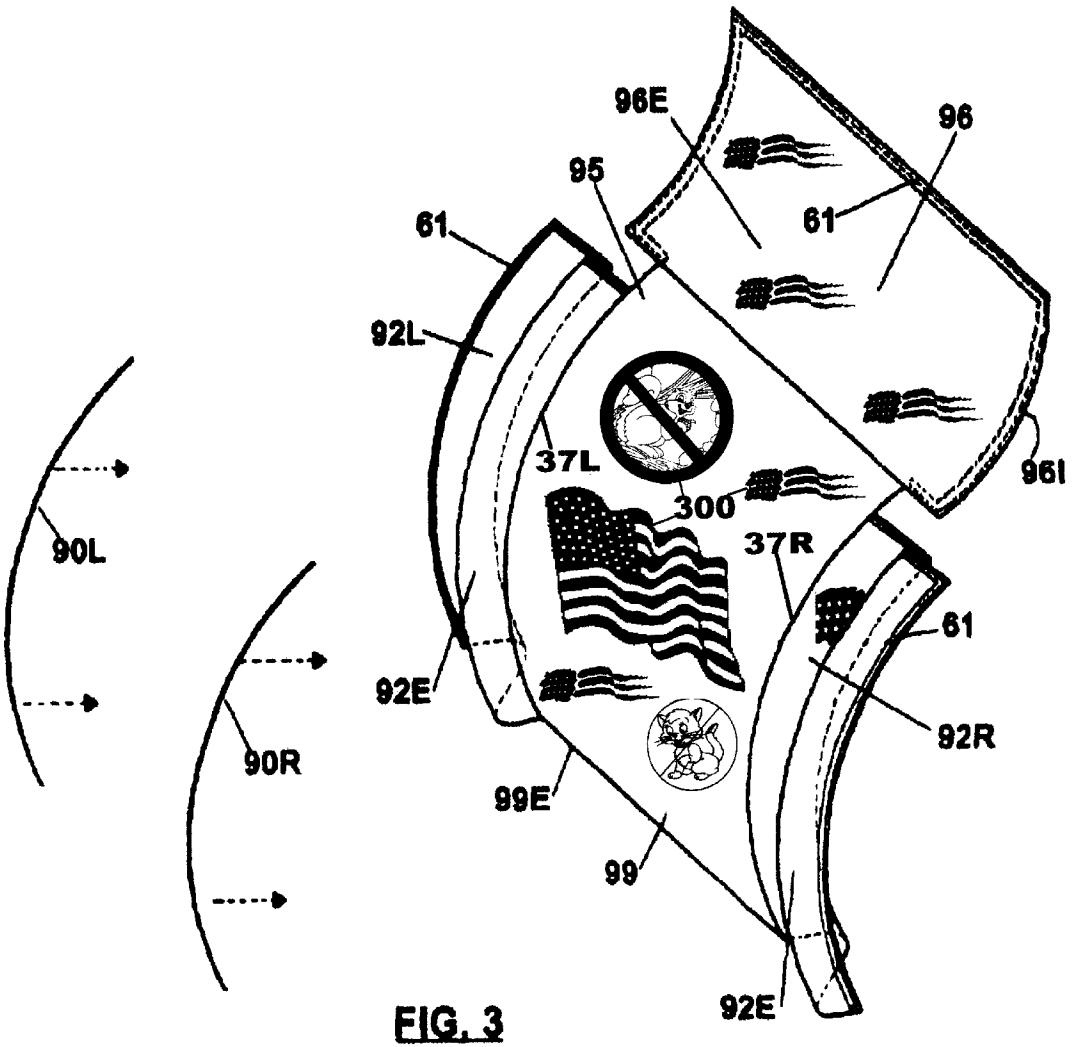
FIG. 3 is a distant exploded left elevation perspective view of parts of the screen sub-assembly, with advertising expressions, of the present invention in a flexed condition.

Referring to FIG. 3, shown are the parts that comprise the screen sub-assembly of the present invention. Said slips 90R, 90L are shown vertically positioned in a flexed condition facing their incorporation points on seams 37R, 37L on an exterior face 99E of said main portion 99. Said screen panel 95 consists of said main portion 99, two said side portions 92R, 92L, said upper portion 96, and advertising expressions 300. One half of a hook and loop fastener 61 is attached to said exterior side 92E of said side portions 92R, 92L and to said interior side 96I of said upper portion 96.

Figure 4:
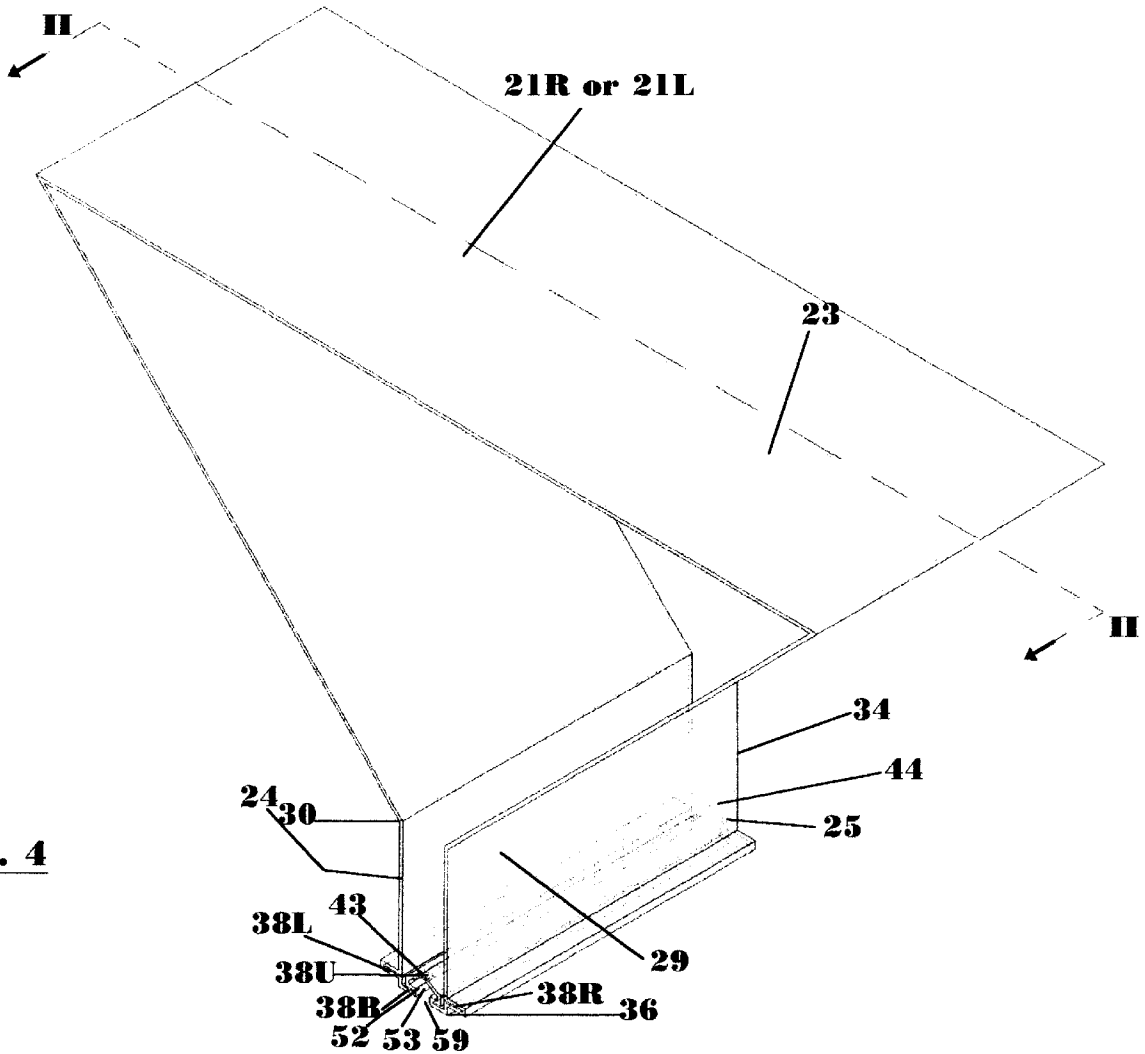
FIG. 4 is a perspective view of parts of the screen assembly shown in FIG. 1 and FIG. 2 laterally crossed by line
Figure 5:
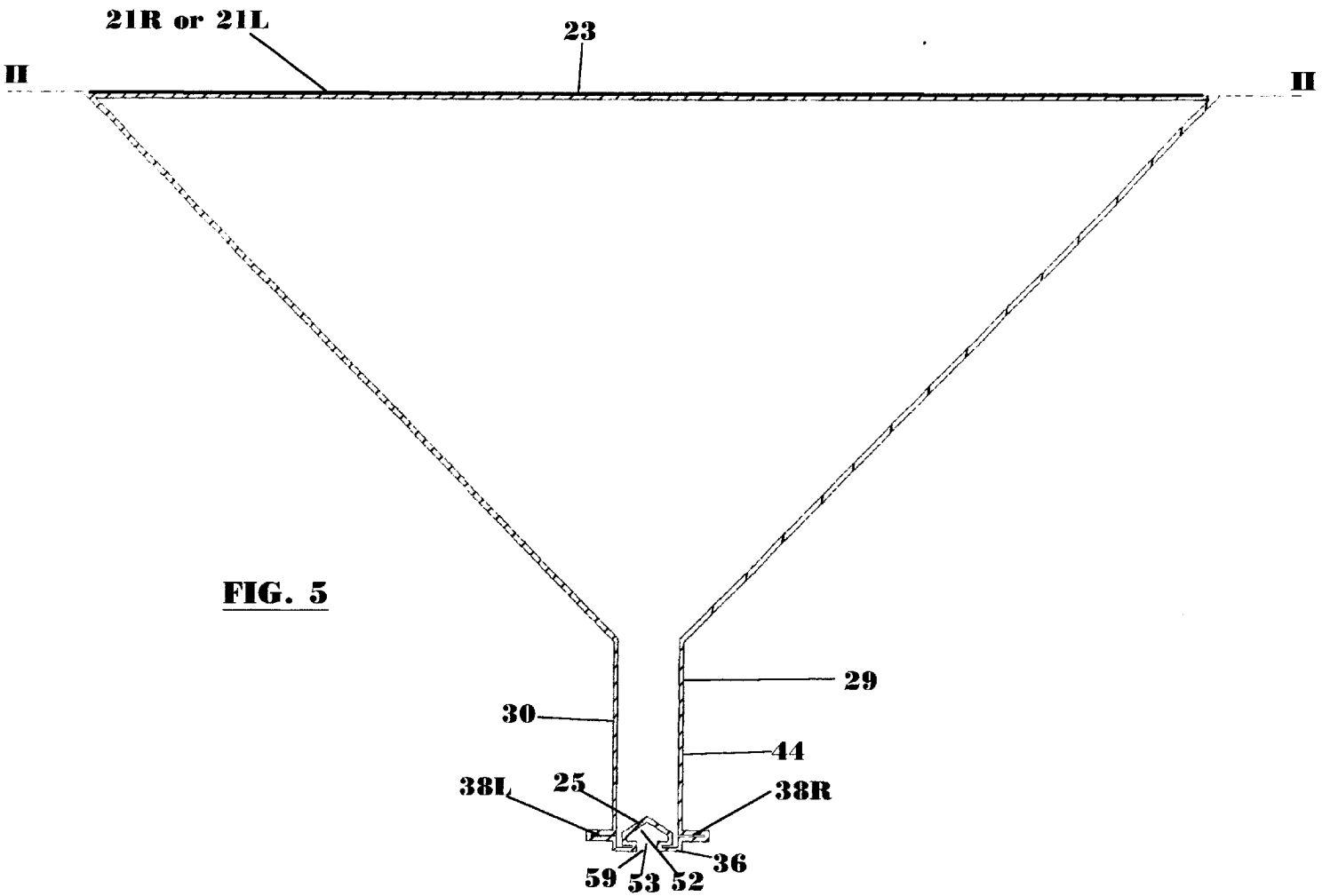
FIG. 5 is a cross-sectional view of FIG. 4 along line II—II.

Referring to FIGS. 4, 5, said bases 21R, 21L of the alternate embodiment each respectively consists of said contact plate 23, said cradle 25, said tower 44, said end of track 43, and receiver wells 38U, 38R, 38L, 38B are all of predetermined dimension. Said cradles 25 consist of said front side 24, said right side 29, a left side 30, said rear side 34, and said base side 36. Said receiver wells 38R, 38L each respectively run through entire profile of said base 21R, 21L, where as receiver wells 38U and 38B are cut into said bases 21R, 21L to allow said track 41R, 41L to seat. Said end of track 43 has a breaching bore 59 which has a cap portion 52 located more towards center breaching no part of said cradle 25 and a stem portion 53 downwardly running ending at said base side 36. In the alternate embodiment, the beginnings and endings of said contact plate 23, said cradle 25, said tower 44, said end of track 43, and said receiver wells 38R, 38L, are somewhat obscured, because they are combined into a single cross-sectional profile. Holes (not shown) are drilled through said cradle 25 over area of said receiver wells 38R, 38L near said front side 24.

Figures 6, 7, 8:
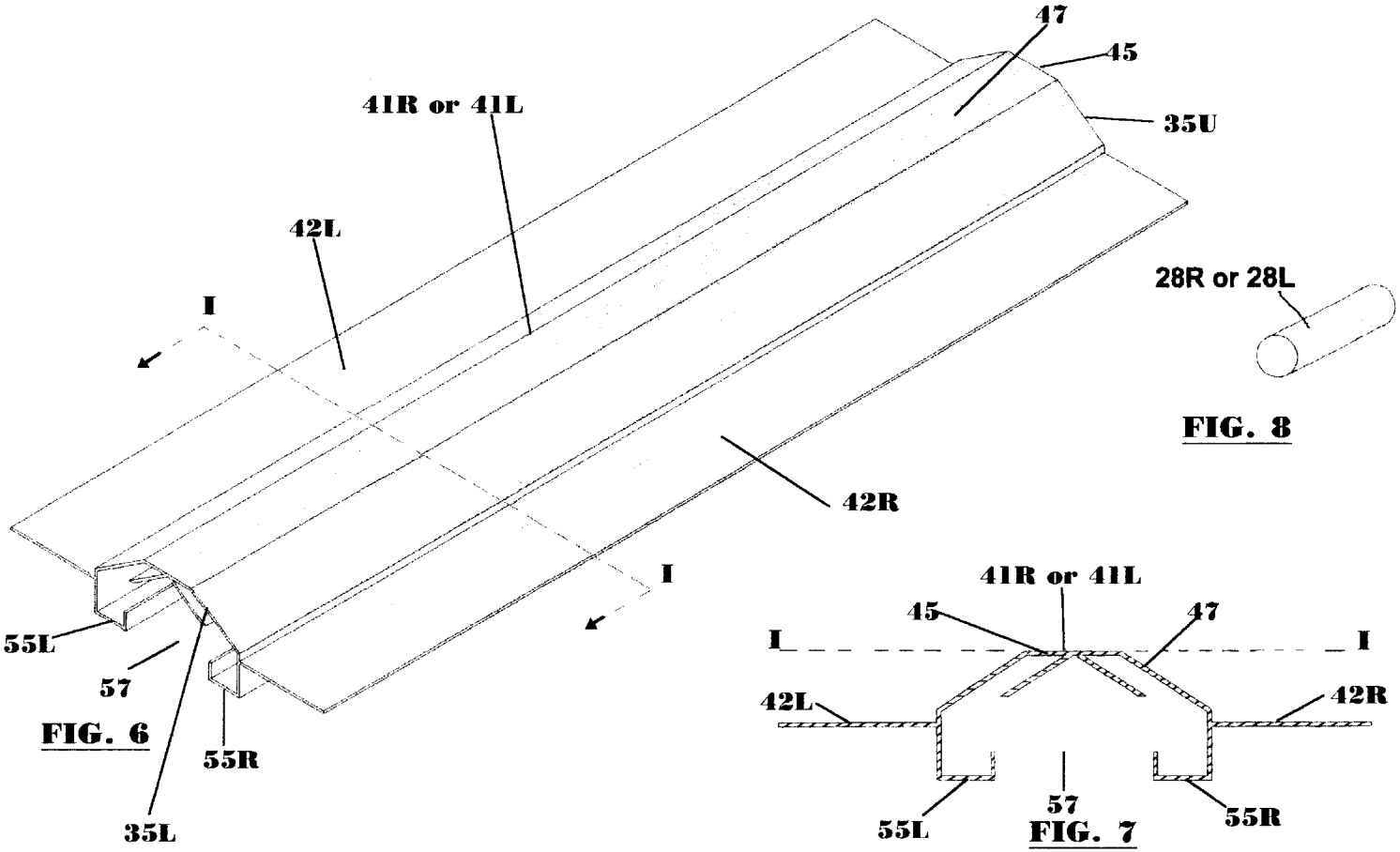
FIG. 6 is a perspective view of parts of the screen assembly shown in FIG. 1 and FIG. 2 laterally crossed by line I—I.
FIG. 7 is a cross-sectional view of FIG. 6 along line I—I
FIG. 8 is a perspective view of parts of the screen assembly shown in FIG. 1 and FIG. 2.

Referring to FIG. 6, said pins 28R, 28L are of predetermined dimension to adequately engage said footings 42R, 42L of said tracks 41L, 41R to said bases 21R, 21L, said drag 72 to said rods 60R, 60L, and said brace 82 to said rods 60R, 60L.

Referring to FIGS. 7, 8, said tracks 41R, 41L in the alternate embodiment consist of said housing 47, said upper arm 45, said lower constraining arms 55R, 55L, said footings 42R, 42L, all of predetermined dimension. Holes (not shown) are drilled through said footing 42R, 42L near a front-end 35L and a rear end 35U. Said lower constraining arms 55R, 55L create an aperture 57. Said housing 47 encompasses said cradle 25, while said upper arm 45 and said lower constraining arms 55R, 55L restrict said housing 47 to provide consistent position between said bases 21R, 21L.

Figures 9, 10:
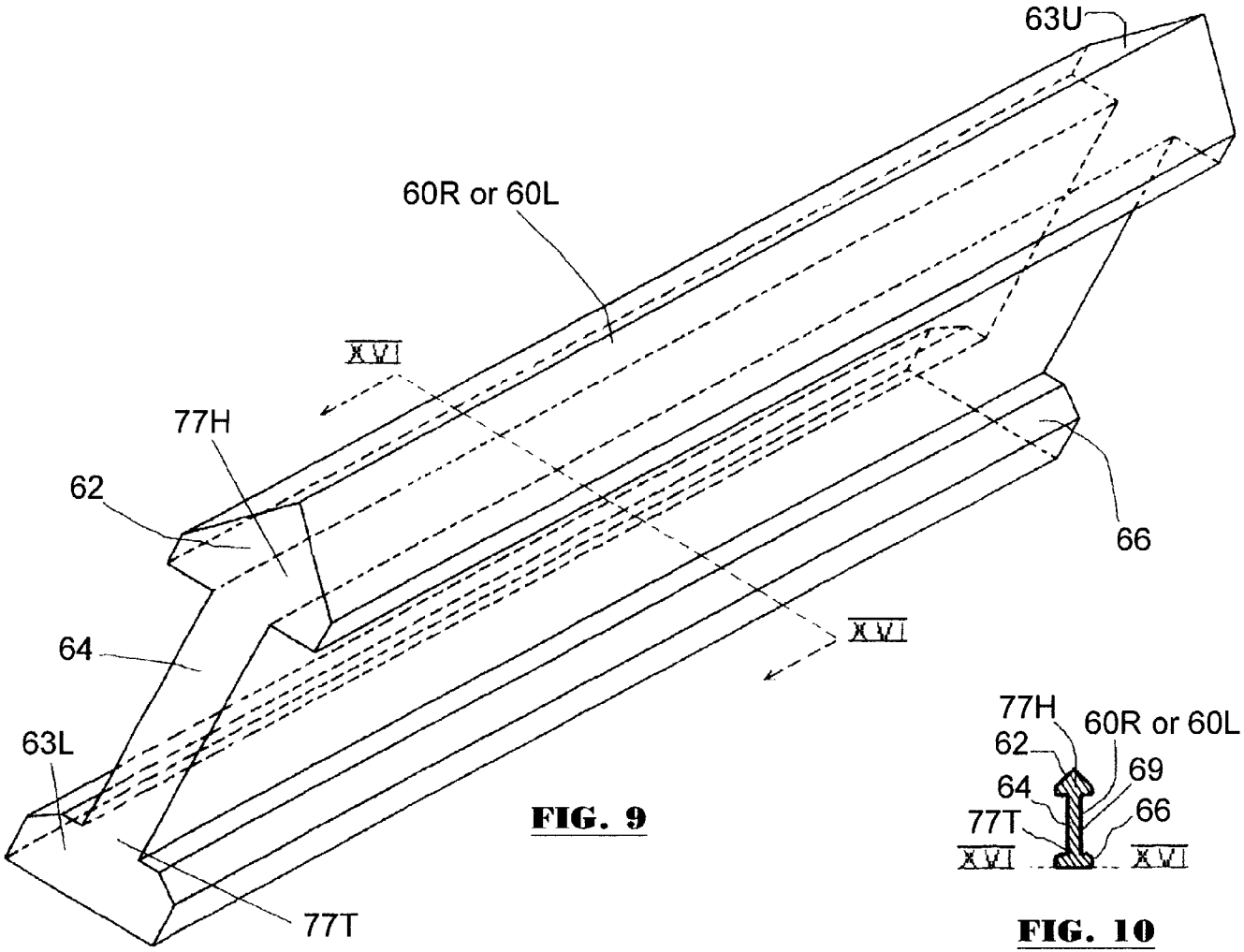
FIG. 9 is a perspective view of parts of the screen assembly shown in FIG. 1 and FIG. 2 laterally crossed by line XVI—XVI.
FIG. 10 is a cross-sectional view of FIG. 9 along line XVI—XVI.

Referring to FIGS. 9, 10, said upper segment 62 of each said rod 60R, 60L is of such predetermined dimension that is wider than that of said middle segment 64, which is of such predetermined dimension that is narrower than that of said lower segment 66. A lateral cross-sectional conformation 69 of said upper 62, middle 64, and lower 66 segments is, therefore, barbell-like in shape, with a middle narrowing. A section of said conformation 69 from said upper segment 62 through half of said middle segment 64 is known as a head segment 77H. A section of said conformation 69 from said lower segment 66 through half of said middle segment 64 is known as a tail segment 77T. Said head segment 77H is shaped to said bore 59 of said tracks 41R, 41L.

Figures 11, 12, 13, 14:
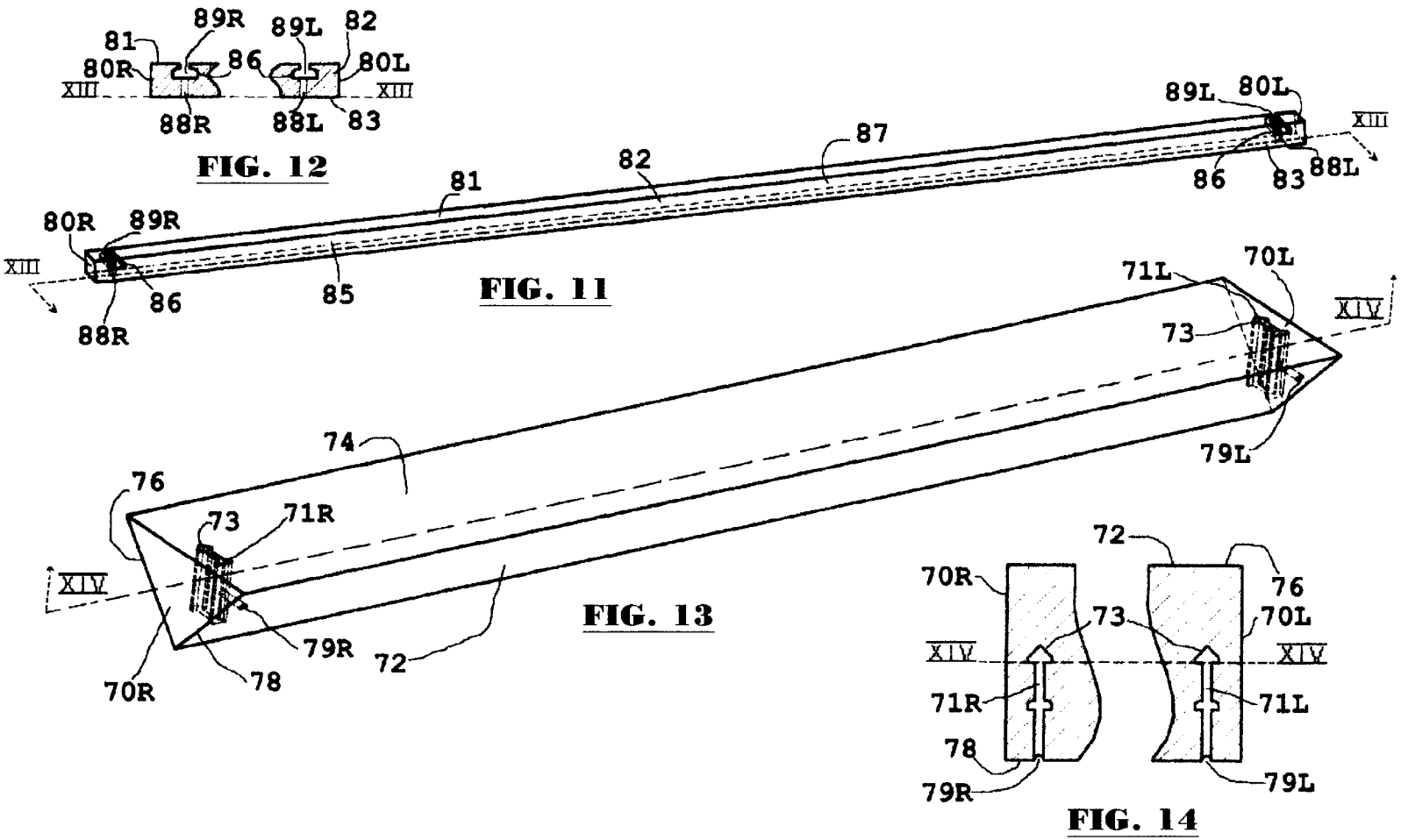
FIG. 11 is a perspective view of a part of the screen assembly shown in FIG. 1 and FIG. 2 longitudinally crossed by line XVII—XVII.
FIG. 12 is a broken cross-sectional view to show ends of FIG. 11 along line XIII—XIII.
FIG. 13 is a perspective view of a part of the screen assembly shown in FIG. 1 and FIG. 2 longitudinally crossed by line XIV—XIV.
FIG. 14 is a broken cross-sectional view to show ends of FIG. 13 along line XIV—XIV.

Referring to FIGS. 11, 12, said drag 72 consists of said end 70R, an opposite end 70L, said base side 74, and said leg sides 76, 78, all of predetermined dimension. Depressions 71R, 71L each disposed from said ends 70R, 70L breach said base side 74. Identical perimeters 73 of said depressions 71R, 71L are consistent with said conformation 69 of said rods 60R, 60L. (See FIGS. 9, 10) Holes 79R, 79L exist through a singular said leg side 78 to said depressions 71R, 71L. In the preferred embodiment, said drag 72 is fabricated out of material with desired rigidity strength characteristics.

Referring to FIGS. 13, 14, said brace 82 consists of said end 80R, said front side 85, said rear side 87, said top side 81, said bottom side 83, and an opposite end 80L, all of predetermined dimension. Latitudinal grooves 89R, 89L each disposed from said ends 80R, 80L breach said front 85, top 81, and rear 87 sides. Said grooves 89R, 89L have an interior perimeter 86 consistent with said tail segment 77T of said rods 60R, 60L. (See FIGS. 9, 10) Holes 88R, 88L exist through said bottom side 83 to said grooves 89R, 89L. In the preferred embodiment said brace 82 is fabricated out of material with desired rigidity strength characteristics.

Figures 15, 16:
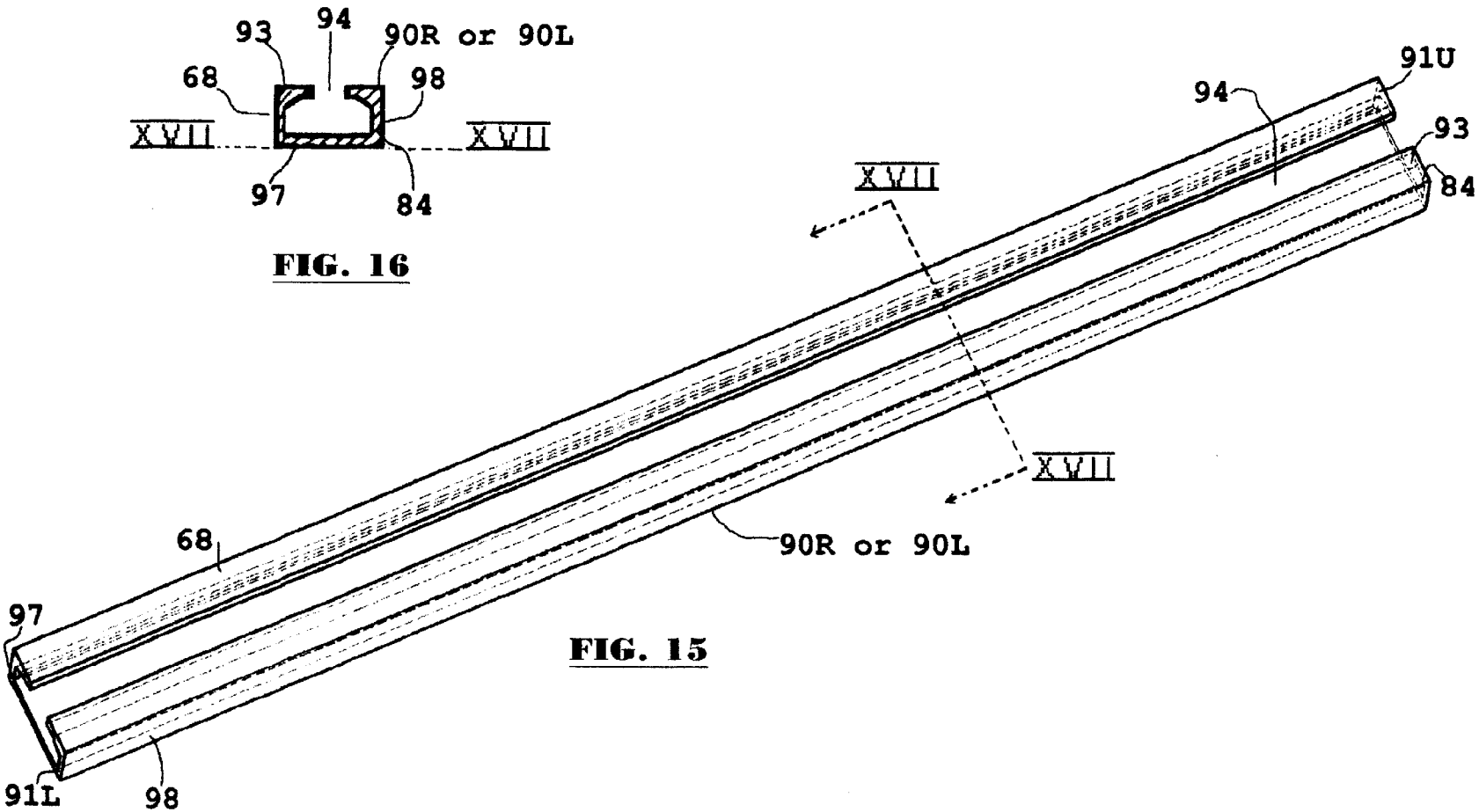
FIG. 15 is a perspective view of a part of the screen assembly shown in FIG. 1 and FIG. 3 laterally crossed by line XVII—XVII.
FIG. 16 is a cross-sectional view of FIG. 15 along line XVII—XVII.

Referring to FIGS. 15, 16, said slips 90R, 90L consist of said right side 98, a left side 68, said top side 93, said bottom side 97, and said ends 91L, 91U, all of predetermined dimension. Longitudinal groove 94 breaches said ends 91L, 91U, and said top side 93. An interior perimeter 84 of said groove is consistent with said tail segment 77T of said rods 60R, 60L. (See FIGS. 9, 10) In the preferred embodiment, said slips 90R, 90L will be fabricated out of material having the desired flexibility characteristics.

Advantages

An elevated track improves the screen assembly by allowing the track to traverse the entire height of a garage door over inherent garage door connecting and supporting means, storing in a retracted condition in parallel juxtaposition to said garage door and for substantial concealment from the public. Fabricating the components of material with desired flexibility, weight and strength characteristics makes imperforate mounting possible, which does not decrease the energy efficiency of a garage as with perforate mounting. The screen assembly is permanently stored against the interior side of a garage door, which with the entirety of said door securely encloses said entryway when said door is in a closed condition and that allows for a selective deployment, which can be manually deployed by a single individual. The use of said screen panel 95 and the plurality of the portions 92R, 92L, 96 to completely enclose a vertical by horizontal overhead garage door entryway 200, including both an opening at top between garage door and header of door jam enclosed by said upper portion 96, and, the side apertures created by bending resilient potentially protruding elongated flexible members 60R, 60L, whereby ends 63L, 63U are pivoted closer together during nonplanar, non-vertical deployment and enclosed by side portions 92R, 92L, is an improvement, since the deployment thereof creates an arcuate path that controls plural fabrics in a single frame such that no portion is parallel to another portion and enjoys an increased multi-faceted visibility. Therefore, advertising expressions 300 displaying on the more visible impressionable medium guided along said nonplanar path which may protrude as necessary through a plurality of areas directly related to said entryway reach a larger audience and represent better advertising space for a personal billboard, thereby allowing a garage owner to express publicly affiliation with entities approved of by said owner reaffirming $1^{st}$ amendment rights and promoting rights to assembly. The personal billboard marketing strategy constituted by the above method in a selectively concealable fashion where a flexible frame is slidably provided for the optional movements of sliding and bending in cooperation with provided said medium to enclose said entryway so as to prevent and deter animal life passage increases the economic viability of the present invention.

Operation

The imperforate mounting of vertical track members 41R, 41L is made by use of an adhesive to secure bases 21R, 21L disposed symmetrically in corners of a garage door. The contacting plate 23 and relative placement position on the garage door are scored to aid in bonding the two together. The symmetrical disposition of the bases 21R, 21L is such that the tracks 41R, 41L can be vertically positioned at opposite ends of the entire interior side of a garage door. Each vertical track 41R, 41L is slidably engaged to respective bases, 21R or 21L, and fixedly held in place by pins 28R, 28L. The track 41R, 41L and the respective bases 21R, 21L combine to a predetermined length, which is approximately equal to a garage door's height. The holes of said base 21R, 21L match holes of said track 41R, 41L. The mushroom-shaped breaching bore 59 encompasses the head 77H of a dual-purpose conjunctive rod 60R, 60L while allowing the tail 77T of rod 60R, 60L to pass outside track 41R, 41L. During operation of a garage door, where bends may be encountered, the rigid stiffness of said bases 21R, 21R prevents a sufficient variance in the breaching bore 59 to lose integrity as a track. Said dual-purpose conjunctive rods 60L, 60R have respective said head portions 77H that slidably engage said vertical tracks 41L, 41R and said breaching bore 59 and respective said tail portions 77T that slidably engage said screen attachment slips 90L, 90R. Respective said head portions 77H are constant throughout most of the elongated rods 60L, 60R, except for an increase in dimension toward its lower end 63L, which acts as a wedge for releasably locking said rods 60L, 60R in said tracks 41L, 41R. Said bases 21R, 21L and said tracks 41L, 41R are fixedly attached to one another and both slidably engage said rods 60L, 60R, and while still engaged, the extended rods 60L, 60R flex arcing from said bases 21R, 21R back toward a floor of garage. A horizontal drag 72 is fixedly attached to the lower ends 43L of respective said rods 60L, 60R to concert the rods 60L, 60R and engage a floor of garage. A horizontal brace 82 is fixedly attached to the tails 77T of respective said rods 60L, 60R approximately above the screen attachment slips 90L, 90R to generally fix the attachment slip's 90L, 90R position and further concert the rods 60L, 60R. Attachment slips 90L, 90R are permanently mounted vertically at opposite end seams 37L, 37R of a main portion 99 of a single screen panel 95. Since the attachment slips 90L, 90R are each slidably attached to tail portions 77T of respective said rods 60L, 60R which are slidably engaged in the tracks 41L, 41R, the main portion 99 remains taught between the two rods 60L, 60R. The main portion 99 covers substantially the entire interior side of the garage door and has auxiliary portions 92L, 92R, and 96 attached respectively vertically at its sides and horizontally at its top. The auxiliary upper portion 96 folds over the horizontal brace 82 so the exterior faces 96E, 99E of respective upper and main portions 96, 99 face each other. When the concerted conjunctive rods 60L, 60R with single screen 95 attached extends arcing from bases 21R, 21L, the upper auxiliary portion 96 moves from an orientation disposed at the top panel 51U of garage door 50 to an orientation disposed at the bottom panel 51L of a garage door 50. When in a deployed condition, the upper portion 96 wraps around the bottom panel 51L of a garage door 50 attaching to an exterior of a garage (not shown) sealing an opening (not shown) between the bottom panel 51L and a door jam (not shown). Half of a hook and loop fastener 61 attached to the interior face 96I of the upper portion 96 connects to the corresponding half (not shown) attached to an exterior of a garage (not shown). The forward bowing, from the garage opening (not shown), exhibited by the extended rods 60L, 60R provides two half-cylindrical openings at the sides (not shown). The side openings (not shown) are sealed by corresponding halves of a hook and loop fastener with one half 61 respectively attached to the exterior faces 92E of side portions 92L, 92R and another half (not shown) to an interior of garage near a door jam (not shown).

Conclusion, Ramifications, and Scope of Invention

Thus the reader will see that the screen assembly of the present invention provides a flexible, highly reliable, storable, and lightweight device that can traverse the entire height of a garage door, mount without perforating a garage door, and be deployed by a single individual. While my above description contains many specificities, these should not be construed as limitations on the scope of the invention, but rather as an exemplification of one preferred embodiment thereof other variations are possible. Many other variations are possible. For example, alternative embodiments may, (a) modify design to attach bases to a garage door, differently;
(b) configure the receiver wells of its bases, differently;
(c) include bases that provide means for screw tightening whereby a male helical screw portion and a female helical screw portion exist to secure a tower component;
(d) combine the base and tower components, so that a base's receiver well is more distant from its contacting plate;
(e) combine the base, tower, and track into a single part;
(f) change the shape of bore of the track;
(g) completely or partially separate the barrel from the towers;
(h) change the shape of either the head or tail segment of the rods or both;
(i) change the shape or section of the drag;
(j) change the shape or section of the brace;
(k) change the shape or section of the slips;
(l) change the shape or section of the pins;
(m) modify the design to include additional bases intermediate the height or ends of garage door to further support tracks at ends or add more tracks;
(n) modify the design to include means to prevent the rods from completely disengaging the tracks by sliding out;
(o) modify the design to include zippered throughway passages in main portion of single screen panel;
(p) modify the design to include a plurality of tie downs for side auxiliary screen portions.

Accordingly, the scope of the invention should be determined not by the embodiment(s) illustrated, but by the appended claims and their legal equivalents.

What is claimed is:

1. A method for advertising expressions within a vertical by horizontal overhead garage door entryway and, as necessary, a plurality of areas directly related to said entryway in a selectively concealable fashion, comprising:

(a) providing a garage door which is able to securely enclose said garage door entryway,
(b) providing an interior side of said garage door,
(c) providing a first means which is impressionable, for displaying said expression,
(d) providing a second means such that said second means can deploy and retract, respectively, for a nonplanar multi-faceted delivery and a substantial concealment of said first means, whereby said advertising expressions will be impressed upon said first means, whereby said second means include flexible elongated members which extend to expose said first and second means to the public such that said second means create a nonplanar path which protrudes through said entryway by bending out and back thereby guiding said first means along said nonplanar path, when said garage door is in an opened condition and retract to substantially conceal said first and second means from the public in a retracted condition in parallel juxtaposition to said garage door, whereby a garage owner expresses publicly affiliation with entities with which the owner approves thereby reaffirming 1st amendment rights and promoting rights to assembly.

2. The method of claim 1 wherein said second means, which is flexible, is mounted for optional movements, sliding and bending.

3. The method of claim 1 wherein said first means, which is flexible, prevent or deter the use of said entryway passage by animal life.

4. The method of claim 1 wherein said elongated members have ends that are pivoted together to create a bowing nonplanar path.

5. The method of claim 1 wherein said first means in cooperation with said second means constitutes plural fabrics in a single frame.

6. A method for advertising expressions within a vertical by horizontal overhead garage door entryway and, as necessary, a plurality of areas directly related to said entryway in a selectively concealable fashion, comprising:

(a) providing a garage door which is able to securely enclose said garage door entryway, (b) providing an interior side of said garage door, (c) providing a slidably mounted flexible medium which is impressionable, for displaying said expression, (d) providing a slidably mounted flexible frame such that said frame can deploy and retract, respectively, for a nonplanar multi-faceted delivery and a substantial concealment of said medium, whereby said advertising expressions will be impressed upon said medium, whereby said frame include flexible elongated members which extend to expose said medium and frame to the public such that said frame creates a nonplanar path which protrudes through said entryway by bending out and back thereby guiding said medium along said nonplanar path, when said garage door is in an opened condition and retract to substantially conceal said medium and frame from the public in a retracted condition in parallel juxtaposition to said garage door, whereby a garage owner expresses publicly affiliation with entities with which the owner approves thereby reaffirming 1st amendment rights and promoting rights to assembly.

7. The method of claim 6 wherein said frame, which is flexible, is mounted for optional movements, sliding and bending.

8. The method of claim 6 wherein said medium, which is flexible, prevents or deters the use of said entryway passage by animal life.

9. The method of claim 6 wherein said elongated members have ends that are pivoted together to create a bowing nonplanar path.

10. The method of claim 6 wherein said medium in cooperation with said frame constitutes plural fabrics in a single frame.

* * * * *